United States Patent [19]

Heinzelmann et al.

[11] 4,192,495

[45] Mar. 11, 1980

[54] FILM FEEDER

[75] Inventors: Karl-Georg Heinzelmann, Neunkirchen; Sigismund Klein, Nuremberg, both of Fed. Rep. of Germany

[73] Assignee: Siemens Aktiengesellschaft, Berlin & Munich, Fed. Rep. of Germany

[21] Appl. No.: 874,515

[22] Filed: Feb. 2, 1978

[30] Foreign Application Priority Data

Feb. 23, 1977 [DE] Fed. Rep. of Germany ..... 2707777

[51] Int. Cl.[2] ..... B65H 5/00

[52] U.S. Cl. ..... 271/10; 271/225; 271/229; 271/251; 271/185

[58] Field of Search ..... 271/10, 225, 229, 251, 271/184, 185

[56] References Cited

U.S. PATENT DOCUMENTS 3,583,697 6/1971 Tippy ..... 271/10

3,758,104 9/1973 Daily ..... 271/185

4,030,722 6/1977 Irvine ..... 271/10

*Primary Examiner*—Richard A. Schacher

*Attorney, Agent, or Firm*—Hill, Van Santen, Steadman, Chiara & Simpson

[57] ABSTRACT

The illustrated embodiment shows a film feeder for feeding individual film sheets to automatic developers. The film feeder has a magazine for receiving a stack of the film sheets, an extraction device and a transport device for transferring the individual film sheets extracted from the magazine into the automatic developer. The transport device contains an apparatus for selectively rotating the film sheets by approximately 45° about their surface normal, and may be utilized with automatic developers which normally receive large-format films sheets, to enable the use of such developers with sheets of substantially shorter length dimension (e.g. 100 mm).

8 Claims, 2 Drawing Figures

FILM FEEDER

BACKGROUND OF THE INVENTION

The invention relates to a film feeder for feeding automatic developers with loose film sheets, having a receiver magazine for the film sheets, having an extraction device and a transport device for the transfer of the individual film sheets extracted from the receiver magazine into the automatic developer. Film feeders of this kind are predominantly used in the x-ray departments of hospitals in order to convey the large number of exposed x-ray film sheets which are produced, into the installed automatic developers.

A film feeder has become known, in which in each case the bottom sheet of the film sheets stacked in the receiver magazine of the film feeder is laterally compressed and extracted by a hook, which grips into the convexity formed, and is pushed in between transport rollers for further conveyance. The transport rollers guide the extracted film sheet directly into the entry slot of a connected automatic developer. In the use of this film feeder of the De Oude Delft Company it is felt to be disadvantageous that, with the 100 mm films which are becoming ever more prevalent in x-ray technology, trouble results from the fact that, in the current automatic developers, the 100 mm films occasionally fall between the transport rollers of the automatic developers because of the transport roller spacing, which is in the same order of magnitude.

SUMMARY OF THE INVENTION

The invention has the underlying objective of showing a way in which 100 mm film sheets can also be developed trouble-free in the current automatic developers which are available in the hospitals and utilized for the other film formats.

In a film feeder of the type named at the outset the transport device therefore inventively contains an apparatus for rotating the film sheets by 45° about their surface normal. The result of the rotation of the film sheets by 45° is that the film sheets are thereafter transported generally parallel to a diagonal thereof. By means of this a somewhat greater transport roller spacing in the automatic developers is reliably operative for a given film sheet length. The costs for the procurement of special automatic developers which are adapted to the 100 mm format can thus be saved.

A likewise simple and space-saving design results if, in further development of the invention, the rotation of the film sheets is brought about by different rotational speed or, alternatively, different rotational direction of the transport rollers of the transport mechanism. By this means special rotary platforms or rotary claws are avoided. The rotation of the film sheets is carried out in the transport plane. An additional plane is not required.

An especially expedient further development of the invention is achieved if the apparatus for rotating the film sheets comprises three shafts arranged successively in the transport direction, and each disposed perpendicular to the transport direction and parallel to the transport plane, with the first shaft in the sheet transport direction carrying a transport roller for association with each of two edge regions of the transport path, and with the second and third shafts in the sheet transport direction carrying respectively one transport roller associated with the edge region and respectively one transport roller associated with the middle of the transport path, all the transport rollers being driven, except for the transport roller arranged on the middle shaft and associated with the middle of the transport path, which latter middle transport roller is slightly braked, but nevertheless is mounted so as to be free-wheeling. With this mode of construction the turning of the film sheets is managed without special rotatable film platforms and without gripping means. The only means made use of for turning the film sheets are the transport rollers, which are necessary anyway for straight-ahead transportation.

In an advantageous refinement of the invention the transport roller on the third shaft in the transport direction, which is associated with the middle of the transport path, can be axially movable and secureable for adjusting the rotation angle of the sheets. By means of the second shaft's transport roller, which is associated with the edge region of the transport path, the film sheets are rotated about the braked or controlled transport roller mounted on the same shaft and associated with the middle of the transport path, until one corner of the film sheet comes into engagement with the middle transport roller of the third shaft in the transport direction. The rotational angle can be adjusted by axial movement of this transport roller. This can become necessary if the film sheets, which are being transported through the automatic developer with one corner forward, hit with this corner into an intake or outlet opening of the automatic developer at a certain rotational angle, and get stuck.

A gentle transporting of the film sheets can be achieved if, in a refinement of the invention, resiliently mounted pressure rollers are associated with all transort rollers for pressing the film against the controlled and driven rollers. With that, the prerequisite for a further improvement is also created at the same time.

In an especially advantageous further development of the invention the pressure roller, which rests against the second shaft's controlled transport roller, which is associated with the middle of the transport path, can be adjustable against the force of a spring. By this means the possibility is opened up, with one and the same film feeder, of transporting film sheets selectively in the orientation in which they are present in the receiver magazine of the film feeder or in an orientation rotated, in relation thereto, about their surface normal. For that purpose it is only necessary that the pressure roller which rests against the controlled transport roller associated with the middle of the transport path be resiliently pressed against this transport roller or be retracted from this transport roller.

Further details of the invention are more specifically explained with the aid of a sample embodiment represented in the figures on the accompanying sheet of drawings; other objects, features and advantages will be apparent from this detailed disclosure and from the appended claims.

DETAILED DESCRIPTION

Figure 1:
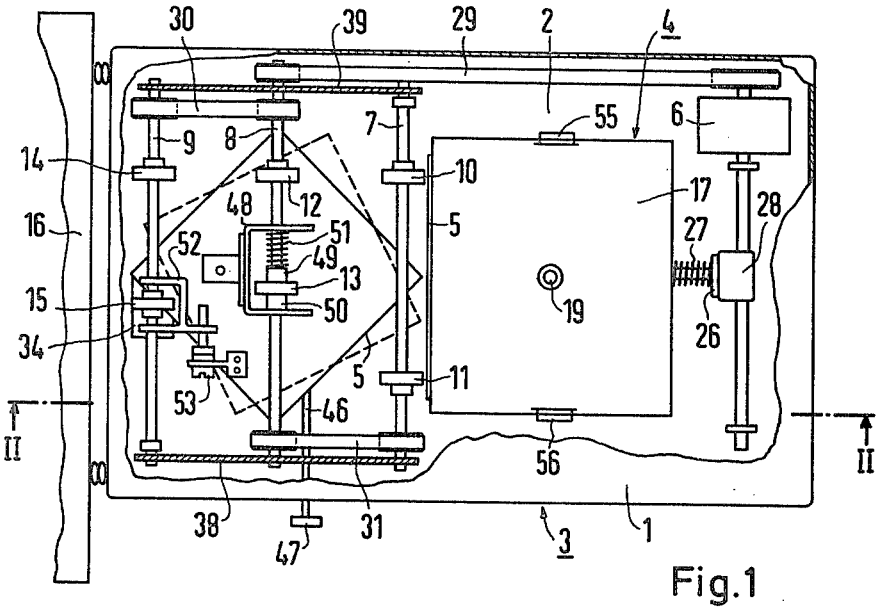
FIG. 1 is a somewhat diagrammatic top view of the film feeder, with partially broken-away upper housing section.

In FIG. 1 a receiver magazine 4 for the film sheets 5 (FIG. 2), a drive motor 6 and three shaft 7, 8, 9 parallel to one another, with transport rollers 10, 11, 12, 13, 14, 15 mounted on the shafts can be recognized through the broken-away cover 1 of the housing 2 of the film feeder 3. These serve for conveying the film sheets 5 extracted from the receiver magazine 4, into an automatic developer 16. In the sectional representation of FIG. 2 the film sheets 5 stored in the housing of the receiver magazine 4 can be recognized. By means of a counter-hold device 19 braced by means of a spring 18 against the cover 17 of the receiver magazine, the film sheets are pressed against the bottom wall portion 20 of the receiver magazine and against a slide 21 set into the bottom wall. In the plane of the bottommost film sheet 5 resting on the bottom wall portion 20 of the receiver magazine 4 and against the slide 21 a calibrated extraction slot 22 is set into the one sidewall of the housing 23 of the receiver magazine 4. On the edge of the slide 21 facing away from the calibrated extraction slot 22 the slide is provided with an ejector nose 24 which projects above the support surface 25 of the slide 21 by about 8/10 of the film thickness. The slide 21 is fastened to a ram 26 which is pressed against a cam disk 28 by a pressure spring 27. This cam disk 28 is coupled to the drive motor 6. Shafts 7, 8, 9 for the transport rollers 10, 11, 12, 13, 14, 15 are also driven by this drive motor 6, via transmission bands 29, 30, 31.

Figure 2:
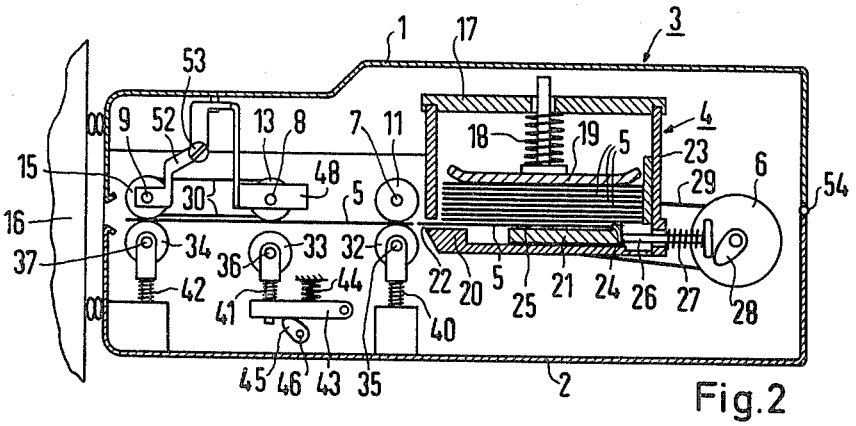
FIG. 2, a diagrammatic vertical sectional view taken along the line II—II of FIG. 1.

As FIG. 2 clearly shows, pressure rollers such as 32, 33, 34 (only three visible) carried on shafts such as 35, 36, 37, are arranged to engage resiliently against the individual transport rollers 10, 11, 12, 13, 14, 15 in the plane of this calibrated extraction slot 22. They are obscured in FIG. 1 by the transport rollers 10, 11, 12, 13, 14, 15 and are therefore not to be seen there. Shafts 7, 8, 9 for the transport rollers 10–15 may be journalled in mounting plates 38, 39 which are attached in the housing 2. Springs 40, 41, 42, are operative to press the pressure rollers such as 32, 33 and 34 against the transport rollers 10, 11, 12, 14, 15, springs 40 and 42 being braced against the housing. Only pressure roller 33 which is associated with the middle transport roller 13 of the second shaft 8 is separately mounted on a rocking lever 43 which serves to brace spring 41. This rocking lever 43 is pressed against a cam disk 45 by a further spring 44. The cam disk 45 can be manually rotated by means of a shaft 46 which is conveyed out of the housing 2 of the film feeder 3 and ends in a rotatable handle 47. By rotating this rotatable handle 47 and thus the cam disk 45, the rocking lever 43 with the pressure roller 33 can be selectively pressed against the middle transport roller 13 of the second axle 8, or be swung away from it to a position such as shown in FIG. 2. Cam 45 is indicated only diagrammatically and would, of course, have a sufficient extent to compress spring 41 to the desired extent when rotated so as to engage pressure roller 33 with controlled transport roller 13.

Shaft 7 which is situated closest to the receiver magazine 4 carries two transport rollers 10, 11 which are respectively associated with one each of the two edge regions of the transport path for the film sheets 5. These two transport rollers 10 and 11 are pinned on shaft 7 for rotation therewith. The second shaft 8 in the transport direction carries a transport roller 12 which is also associated with the edge region of the transport path and pinned to the shaft 8. In addition, this second shaft 8 carries a further, free-wheeling transport roller 13 which is mounted on shaft 8 in a longitudinally shiftable manner. This transport roller 13 is laterally guided on the shaft 8 by a fork-like mounting 48. In the simple embodiment it is further distant, by seven millimeters (7 mm), from the transport roller 12 pinned on the same shaft 8 than would correspond to the mid-line of the transport path. On the second shaft 8 one braking disk 49, 50 is mounted on each side of the transport roller 13 and guided by the fork-like mounting 48. The braking disks 49, 50 are both pressed against the free-wheeling transport roller 13 by a pressure spring 51 braced in the fork-like mounting 48. By means of these braking disks 49 and 50 the free-wheeling transport roller 13 is slightly braked. Like the second shaft 8, the third shaft 9 in the transport direction carries two transport rollers 14, 15, one of which (14) is associated with the edge region and the other (15) with the central region of the transport path. Both transport rollers 14, 15 are mounted for rotation with the shaft 9, except that the transport roller 15 which is associated with the middle of the transport path is guided in a fork 52 in a longitudinally movable manner (e.g. a spline permitting such longitudinal adjustment). This fork 52 is axially shiftable via an adjustment screw 53. All three shafts 7, 8, 9 of the transport mechanism are situated at a mutual spacing interval of somewhat more (10 to 15%) than half the film sheets' edge length in the transport direction.

For putting the film feeder into operation the cover 1 of the film feeder 3 is swung upward on its hinge 54, and the cover 17 of the receiver magazine 4 is removed, together with the film counterhold 19. After a stack of film sheets 5 has been placed into the receiver magazine 4, the cover 17 of the receiver magazine 4 is fastened on the receiver magazine with the aid of clamps 55, 56, FIG. 1, and the cover 1 of the film feeder 3 is closed. In this position the film sheets 5 located in the receiver magazine 4 are pressed, by the spring-loaded film counter-hold 19, against the bottom wall portion 20 of the receiver magazine and against the slide 21 set into it.

On putting the film feeder into operation the cam disk 28 is rotated by the drive motor 6, and the ram 26 of the slide 21 is thrust into the interior of the receiver magazine 4 by the cam disk. In the process the ejector nose 24 attached to the slide, which ejector nose projects above its stop or support surface 25 for the film sheets by only about 8/10 of a film thickness, grips behind the rear edge of the film sheet lying directly on the slide surface 25 and, during the slide stroke, pushes the film sheet in the direction of the calibrated extraction slot 22. The film sheet resting directly on the bottom wall portion 20 of the receiver magazine is pushed through the calibrated extraction slot 22. The remaining film sheets 5 are held back by the wall above the calibrated extraction slot 22. The film sheet pushed through the calibrated extraction slot 22 is pushed in between the transport rollers 10, 11 of the first shaft 7 and the pressure rollers such as 32 resting resiliently against these transport rollers, said rollers being situated immediately adjacent the calibrated extraction slot 22 with respect to the transport direction. The transport rollers draw the film sheet completely out of the receiver magazine 4. On further rotation of the cam disk 28 the ram 26 is released, and the slide 21 is pushed back into its starting position by the pressure spring 27 with the front edge of nose 24 behind the rear edge of the next sheet in the stack. The ejected film sheet, however, is conveyed along by the transport rollers 10, 11 of the first shaft 7 which is situated closest to the receiver magazine 4, and is pushed in between the transport roller 12, 13 of the second shaft 8 and the pressure rollers such as 33 associated therewith.

As soon as the extracted film sheet has left the transport rollers 10, 11 of the shaft 7 situated closest to the receiver magazine 4, only its edge region is still moved further along forwards by transport roller 12 of the second shaft 8. In the central region of the film sheet it is held fast by the braked transport roller 13 of the second shaft, so that the sheet is rotated about the middle transport roller 13. This rotation continues until the forward-turned corner of the film sheet 5 (FIG. 1) is pushed between the middle transport roller 15 of the third shaft 9 and its pressure roller 34. The rotated orientation attained by the sheet 5 is substantially that shown in solid outline at 5 in FIG. 1, with a diagonal of sheet 5 substantially parallel to the sheet transport direction (toward developer 16). In the new, rotated orientation, the sheet 5 is then conveyed further by the middle transport roller 15 and its pressure roller 34 as well as by the transport roller 12, of the middle shaft 8, associated with the edge region, and the transport roller 14 fixedly attached on the third shaft 9 in the edge region of the transport section; the sheet is thus drawn out of the region of the middle transport roller 13 of the middle shaft 8.

With the adjustment screw 53 the fork 52, together with the middle transport roller 15, can be axially shifted on the third shaft 9. Since the rotation of the film sheet is not concluded until the leading edge of the film sheet in transport direction is grasped by this axially movable transport roller 15, the angle up to which the film sheet is rotated about its surface normal can be adjusted by moving the adjustment screw 53. Further, the cam disk 45, FIG. 2, can be rotated with the rotatable handle 47. The former presses the rocking lever 43 of the pressure roller 33 against the braked transport roller 13 mounted on the middle axle 8, or lifts it away. If this rocking lever 43 is swung counterclockwise to the position shown in FIG. 2, then it not longer presses this pressure roller 33 against the braked transport roller 13. Consequently the film sheet is no longer held fast by this transport roller 13 when it has left the transport rollers 10, 11 of the first shaft 7 adjacent to the receiver magazine. In this case the film sheet is transported by the transport rollers 10, 11, 12, 14, 15 into the automatic developer 16 in the same orientation as the sheet has in the receiver magazine 4.

By means of the rotatable handle 47 it would also be possible instead of retracting the pressure roller 33 as shown in FIG. 2, to raise an end of the middle shaft 8 at its bearing point in the mounting plate 38. As a result of that the braked middle transport roller 13 of the middle axle 8 would be lifted up from the transport plane. In this case, as well, the film sheets would no longer be rotated. Further, it would also be possible to cut the shafts 7, 8, 9, 35, 37 in the middle and to separately mount each transport roller and pressure roller, and to drive rollers 11 and 15 separately from the illustrated drive for rollers 10, 12 and 14.

The axial extent of pressure roller 34 may correspond to the range of axial adjustment of roller 15, for example. The sheet extractor drive 26–28 may be of conventional construction and need not be further indicated herein. The sheet rotation apparatus (7 to 15, 48 to 51) in the illustrated embodiment relies on the different rotational characteristic of the braked transport roller 13 (when the sheets are engaged therewith by shifting of the cooperating biased pressure roller 33 to its upper active position). Instead of different rotational rates, the sheet rotation apparatus may utilize different rotational directions of respective transport rollers to rotate the sheet, for example.

It will be apparent that many modifications and variations may be effected without departing from the scope of the novel concepts and teachings of the present invention.

I claim as my invention:

1. A film feeder for feeding automatic developers with individual film sheets, including a receiver magazine for the film sheets, an extraction device and a transport device for the transferral of the individual film sheets extracted from the receiver magazine in a sheet transport direction for supply to an automatic developer, the transport device having sheet rotation apparatus (7 to 15, 48 to 51) for the rotation of the film sheets (5) by approximately 45° about their surface normal, characterized in that the sheet rotation apparatus for rotating the film sheets (5) comprises three shafts (7, 8, 9) arranged successively in the sheet transport direction, each disposed generally perpendicularly to the sheet transport direction and parallel to the transport plane, the first shaft (7) in the sheet transport direction carrying driven transport rollers (10, 11) each associated with one of two edge regions of the transport path, the second and third shafts (8, 9) in the sheet transport direction each carrying a driven transport roller (12, 14) associated respectively with one edge region, the third shaft carrying a driven transport roller (15) associated with the middle of a transport path, and a controlled transport roller (13) arranged on the second shaft (8) and associated with the middle of the transport path, said controlled transport roller being slightly braked but mounted in a free-wheeling manner on the second shaft.

2. A film feeder according to claim 1, characterized in that the transport roller (15) of the third shaft (9) in transport direction associated with the middle of the transport path, is axially movable and securable for adjusting the rotational angle of the film sheets (5).

3. A film feeder according to claim 1, characterized in that resiliently mounted pressure rollers (32, 33, 34) are associated with all of the transport rollers (10 to 15) for pressing the film sheets against them.

4. A film feeder according to claim 3, characterized in that the pressure roller (33) which is operable to press the film sheets against the controlled transport roller (13) of the second shaft (8) and associated with the middle of transport path, is selectively retractable from its pressing relation to the film sheets, to provide for feed of the sheets without rotation thereof.

5. A film feeder according to claim 1, characterized in that the controlled transport roller (13) of the second shaft (8) associated with the middle of the transport path, is retractable from the associated pressure roller (33) by tilting the second shaft, to provide for feed of the sheets without rotation thereof.

6. A film feeder according to claim 1, characterized in that the controlled transport roller (13) of the second shaft (8) associated with the middle of the transport path, is mounted thereon axially offset a few millimeters from the mid-line of the transport path.

7. A film feeder according to claim 1, characterized in that the sheet rotation apparatus (7–15, 48–51) comprises shafts (7, 8, 9) and transport rollers (10–15) thereon for rotating the film sheets (5), the shafts being somewhat more than half the film sheets' edge length apart from one another, with respect to the sheet transport direction.

8. A film feeder according to claim 1, characterized in that the sheet rotation apparatus (7–15, 48–51) comprises shafts (7, 8, 9) spaced along the sheet transport direction and transport rollers (10–15) on said shafts for rotating the film sheets (5), the receiver magazine (4) for the film sheets (5) having an interior boundary wall aligned parallel to the shafts (7, 8, 9) carrying the transport rollers (10–15) and perpendicular to the sheet transport direction.

* * * * *